US010041320B2

(12) United States Patent
Clemens

(10) Patent No.: US 10,041,320 B2
(45) Date of Patent: Aug. 7, 2018

(54) WELLBORE TUBING CUTTING TOOL

(71) Applicant: Halliburton Energy Services, Inc., Houston, TX (US)

(72) Inventor: Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 172 days.

(21) Appl. No.: 15/028,256

(22) PCT Filed: Nov. 13, 2013

(86) PCT No.: PCT/US2013/069941
§ 371 (c)(1),
(2) Date: Apr. 8, 2016

(87) PCT Pub. No.: WO2015/072987
PCT Pub. Date: May 21, 2015

(65) Prior Publication Data
US 2016/0245031 A1 Aug. 25, 2016

(51) Int. Cl.
*E21B 10/32* (2006.01)
*E21B 29/00* (2006.01)
*E21B 23/01* (2006.01)
*E21B 43/112* (2006.01)

(52) U.S. Cl.
CPC ..... *E21B 29/005* (2013.01); *E21B 23/01* (2013.01); *E21B 43/112* (2013.01)

(58) Field of Classification Search
CPC ..... E21B 10/322; E21B 29/005; E21B 10/32
See application file for complete search history.

(56) References Cited

U.S. PATENT DOCUMENTS 1,643,572 A * 9/1927 Black ..... E21B 29/005 166/55.7
1,643,709 A * 9/1927 Fawcett ..... E21B 29/005 166/55.7
2,200,172 A * 5/1940 Howard ..... E21B 29/005 166/55.7

(Continued)

FOREIGN PATENT DOCUMENTS

WO 2012164023 12/2012

OTHER PUBLICATIONS

International Patent Application No. PCT/US2013/069941, International Search Report and Written Opinion dated Aug. 14, 2014, 15 pages.

(Continued)

*Primary Examiner* — Kipp C Wallace
(74) *Attorney, Agent, or Firm* — Kilpatrick Townsend & Stockton LLP

(57) ABSTRACT

In some aspects, a cutting tool is provided. The cutting tool can include a mandrel, a sleeve, and first and second cutting elements. The mandrel can include first and second protrusions positioned at respective first and second lengths along the mandrel. The sleeve can at least partially surround the mandrel. Each of the first and second cutting elements can move from a respective position within the sleeve to a respective position at least partially protruding from the sleeve in response to a respective force exerted by a respective one of the first and second protrusions.

20 Claims, 6 Drawing Sheets

(56) References Cited

U.S. PATENT DOCUMENTS

| | | | | | |
|---|---|---|---|---|---|
| 2,208,011 | A * | 7/1940 | Anderson | E21B 29/005 | 166/55.7 |
| 2,215,632 | A * | 9/1940 | Brack | E21B 29/005 | 166/55.3 |
| 2,940,522 | A * | 6/1960 | Taylor | E21B 10/006 | 166/55.8 |
| 5,060,738 | A * | 10/1991 | Pittard | E21B 10/322 | 166/55.8 |
| 5,074,355 | A * | 12/1991 | Lennon | E21B 10/322 | 166/297 |
| 5,242,017 | A | 9/1993 | Hailey | | |
| 5,735,359 | A * | 4/1998 | Lee | E21B 10/322 | 175/269 |
| 5,791,409 | A * | 8/1998 | Flanders | E21B 29/005 | 166/298 |
| 5,862,870 | A * | 1/1999 | Hutchinson | E21B 29/005 | 166/55.8 |
| 7,467,661 | B2 * | 12/2008 | Gordon | E21B 43/112 | 166/298 |
| 2010/0006290 | A1 | 1/2010 | Saylor, III et al. | | |
| 2011/0155465 | A1 * | 6/2011 | Allamon | E21B 10/322 | 175/57 |

OTHER PUBLICATIONS

Schlumberger , "Drillpipe and Casing Cutters", retrieved from the internet at http://www.slb.com/services/well_intervention/fishing_services/cutters.aspx at least as early as Jun. 19, 2013, 1 page.

Welltec , "Mechanical Solutions", retrieved from the internet at http://www.welltec.com/solutions/mechanical-solutions/ at least as early as Jun. 19, 2013, 13 pages.

* cited by examiner

WELLBORE TUBING CUTTING TOOL

CROSS-REFERENCE TO RELATED APPLICATIONS

This is a U.S. national phase under 35 U.S.C. 371 of International Patent Application No. PCT/US2013/069941, titled "Wellbore Tubing Cutting Tool" and filed Nov. 13, 2013, the entirety of which is incorporated herein by reference.

TECHNICAL FIELD

The present disclosure relates generally to devices for use in a wellbore in a subterranean formation and, more particularly (although not necessarily exclusively), to tools for cutting a tubular element in a wellbore.

BACKGROUND

Various devices can be placed in a well traversing a hydrocarbon-bearing subterranean formation. Production tubing can be inserted in a wellbore to provide a conduit for formation fluids, such as production fluids produced from the subterranean formation. Changing or otherwise modifying tubing placed in a well may require cutting of the tubing. Some prior tubing cutting solutions may involve using explosives for cutting tubing sections. Using explosives for tubing cutting may increase a risk factor of well operations.

Simplified solutions for cutting tubing are desirable.

DETAILED DESCRIPTION

Figure 1:
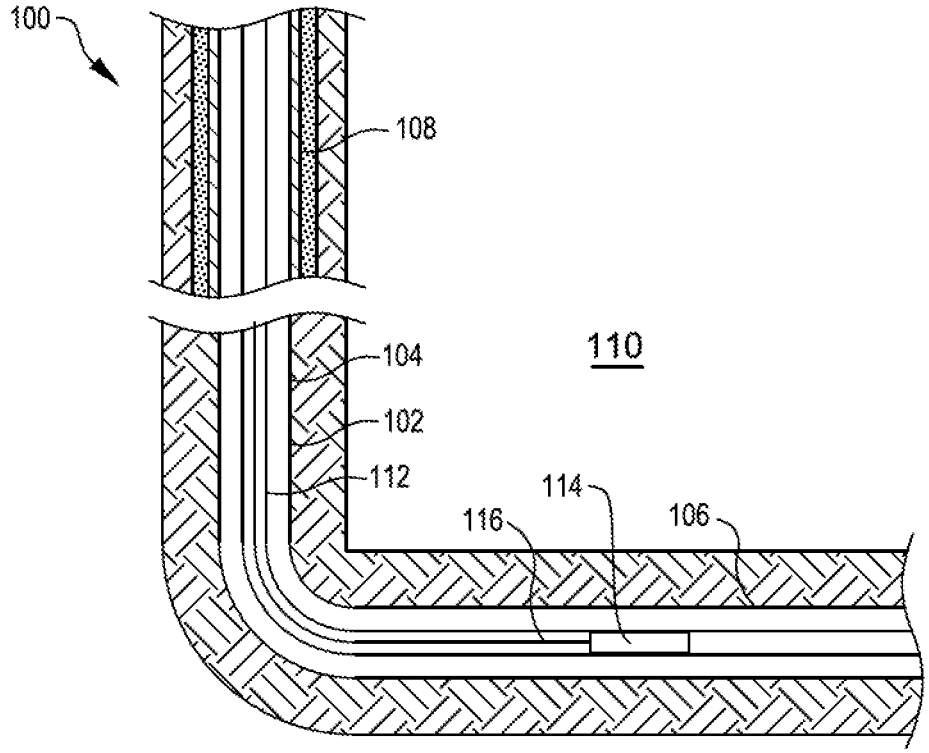
FIG. 1 is a schematic illustration of a well system in which a cutting tool is deployed according to one aspect of the present disclosure.

Certain aspects of the present invention are directed to tools for cutting a tubular element in a wellbore. A cutting tool can include a sleeve and a shaft (or mandrel) that can be inserted into the sleeve. The cutting tool can be deployed within an inner diameter of a tubing section to be severed. A cutting operation can be performed by applying a force to the mandrel that pushes the mandrel through the sleeve. A contoured surface of the mandrel can push cutting elements arranged around a perimeter of the sleeve outward as the mandrel is pushed through the sleeve. The outward or radial movement of the cutting elements can push the cutting elements into the tubing section surrounding the cutting tool. Pushing the cutting elements into the tubing section can sever or otherwise cut into the tubing section.

Cutting the tubing section can involve the cutting elements displacing or deforming portions of the tubing section to create a series of holes around the perimeter of the tubing section. In some aspects, the series of holes can abut one another, providing a continuous cut through the circumference or outer perimeter of the tubing section that severs adjacent portions of the tubing section. In one example, cutting elements can be arranged to provide a continuous 360 degree cut in a tubing section to sever an upper section of the tubing from a lower section of the tubing. In other aspects, the series of holes provide a discontinuous cut that can weaken the tubing section. Weakening the tubing section can allow the tubing section to sever at the cutting location under the weight of the tubing section or under an axial force exerted on the tubing section.

In some aspects, the contoured outer surface of the mandrel can include protrusions aligned along a length of the mandrel. Pushing the mandrel through the sleeve can cause different protrusions along the length of the mandrel to engage different cutting elements arranged around the perimeter of the sleeve. The engagement between a particular protrusion and a particular cutting element can cause the cutting element to extend radially for cutting or perforating a tubing section. In such arrangements, a constant linear force exerted axially on the mandrel can provide a series of radial cuts in the tubing section. Cutting around an entire perimeter of the tubing with a temporally staggered series of cuts rather than with several simultaneous cuts can allow a lower magnitude of force to be exerted on the mandrel to complete the entire cut.

These illustrative examples are given to introduce the reader to the general subject matter discussed here and are not intended to limit the scope of the disclosed concepts. The following describes various additional aspects and examples with reference to the drawings in which like numerals indicate like elements, and directional descriptions are used to describe the illustrative aspects. The following sections uses directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

FIG. 1 schematically depicts an example of a well system 100 in which a cutting tool 114 is deployed. The well system 100 includes a bore that is a wellbore 102 extending through various earth strata. The wellbore 102 has a substantially vertical section 104 and a substantially horizontal section 106. The substantially vertical section 104 and the substantially horizontal section 106 can include a casing string 108 cemented at an upper portion of the substantially vertical section 104. The substantially horizontal section 106 extends through a hydrocarbon bearing subterranean formation 110.

A tubing string 112 within the wellbore 102 can extend from the surface to the subterranean formation 110. The tubing string 112 can provide a conduit for formation fluids, such as production fluids produced from the subterranean formation 110, to travel from the substantially horizontal section 106 to the surface. Pressure from a bore in a subterranean formation 110 can cause formation fluids, including production fluids such as gas or petroleum, to flow to the surface.

A cutting tool 114 can be deployed into the well system 100. In some aspects, the cutting tool 114 can cut a portion of the tubing string 112 for separating the single portion of the tubing string 112 into two portions. The cutting tool 114 can be deployed into the well system 100 on a wire 116 or other suitable mechanism. The cutting tool 114 can be deployed into the tubing string 112. In some aspects, the cutting tool 114 can be deployed as part of the tubing string 112 and the wire 116 can be omitted.

Although the well system 100 is depicted with one cutting tool 114, any number of cutting tools 114 can be used in the well system 100. Although FIG. 1 depicts the cutting tool 114 in the substantially horizontal section 106, the cutting tool 114 can be located, additionally or alternatively, in the substantially vertical section 104. In some aspects, the cutting tool 114 can be disposed in simpler wellbores, such as wellbores having only a substantially vertical section. The cutting tool 114 can be disposed in openhole environments, as depicted in FIG. 1, or in cased wells.

Figure 2:
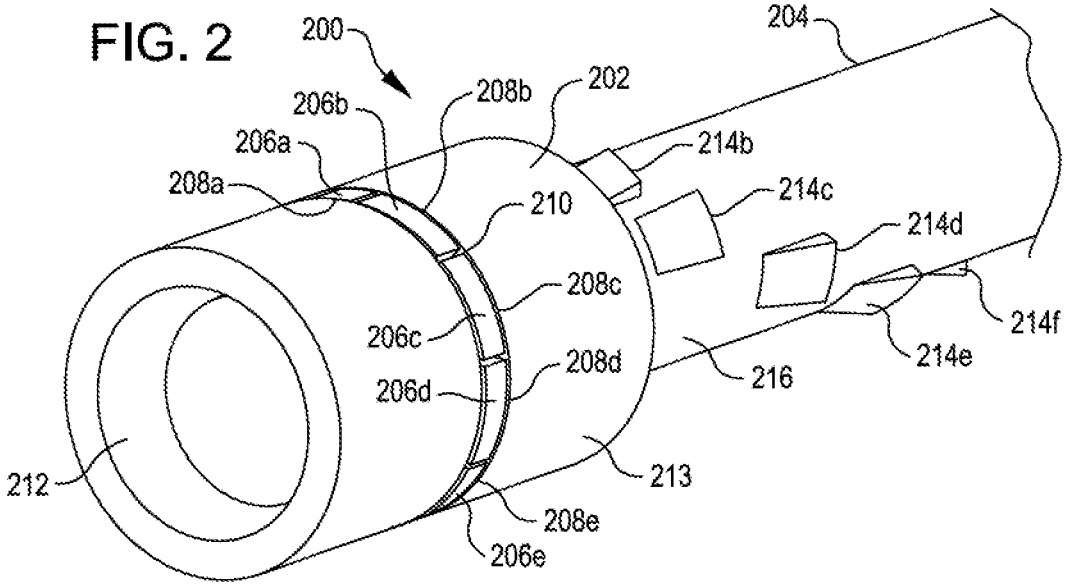
FIG. 2 is a perspective view of an example of a cutting tool according to one aspect of the present disclosure.

Different types of cutting tools 114 can be used in the well system 100 depicted in FIG. 1. For example, FIG. 2 is a perspective view of an example of a cutting tool 200. The cutting tool 200 can include a sleeve 202, a mandrel 204, and one or more cutting elements 206*a-i*.

The sleeve 202 can include a groove with groove segments 208*a-i*. The groove including the groove segments 208*a-i* can be defined along a continuous perimeter 210 of the sleeve 202. The cutting elements 206*a-i* can be arranged along the continuous perimeter 210. For example, the cutting elements 206*a-i* can be arranged spanning the circumference of the sleeve 202. The cutting elements 206*a-i* can be positioned at least partially within the sleeve 202. For example, the cutting elements 206*a-i* can be positioned, respectively, within the groove segments 208*a-i*. Each of the cutting elements 206*a-i* can move between an unextended state and an extended state. In an unextended state, outer surfaces of the cutting elements 206*a-i* can be aligned with or near an outer surface 213 of the sleeve 202. For example, the outer surface of the cutting element 206*b* can be slightly protruding from, slightly recessed from, or substantially flush with the outer surface 213 of the sleeve 202. The sleeve 202 can define a bore 212 through the interior of the sleeve 202.

The mandrel 204 can have an outer surface 216 with an uneven contour. The contour of the outer surface 216 of the mandrel 204 can be uneven for engaging the cutting elements 206*a-i*, as described more fully with respect to FIGS. 3 and 4 below. The contour of the outer surface 216 of the mandrel 204 can include protrusions 214*a-i* arranged along the mandrel 204. The protrusions 214*a-i* can be integral with the outer surface 216 of the mandrel 204. In one example, the mandrel 204 can be formed from a machined cylinder such that the protrusions 214*a-i* are of one piece with mandrel 204. In another example, the mandrel 204 can be cast in a mold having the protrusions 214*a-i* defined therein. In some aspects, the protrusions 214*a-i* are attached to the mandrel 204 during fabrication of the mandrel 204. The protrusions 214*a-i* can be arranged in a spiral pattern along a longitudinal length of the mandrel 204. The mandrel 204 can be sized for moving within the bore 212 of the sleeve 202.

Figure 3:
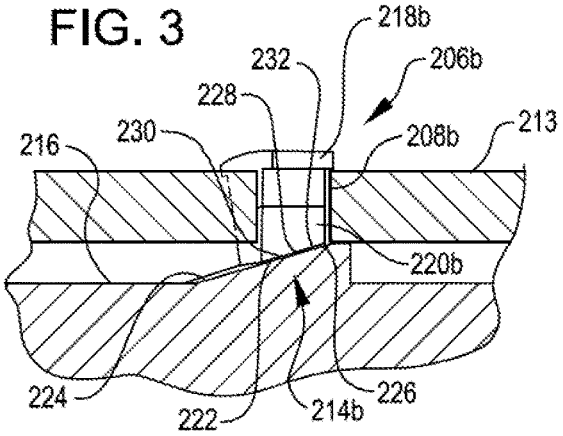
FIG. 3 is a cross sectional view of a protrusion on a mandrel contacting a cutting element according to one aspect of the present disclosure.

FIG. 3 is a cross sectional view of the protrusion 214*b* on the mandrel 204 contacting the cutting element 206*b*. Movement of the mandrel 204 within the sleeve 202 can move the protrusion 214*b* from the position depicted in FIG. 2 into contact with the cutting element 206*b*, as depicted in FIG. 3.

The outer surface 216 of the mandrel 204 can include a cam surface 222. In one example, the cam surface 222 can be on the protrusion 214*b*. The cutting element 206*b* can include a cam-following surface 228. The cam-following surface 228 can move in response to movement of the cam surface 222. In one example, axial movement of the cam surface 222 can apply a force to the cam-following surface 228 that causes radial movement of the cam-following surface 228. Movement of the cam-following surface 228 can cause the cutting element 206*b* to radially extend out of the groove segment 208*b* relative to the sleeve 202.

In some aspects, the cam surface 222 of the mandrel 204 can be an angled or inclined surface, such as a ramp. In one example, the cam surface 222 on the mandrel 204 can have a leading edge 224 and a trailing edge 226. The leading edge 224 can enter the bore 212 of the sleeve 202 ahead of the trailing edge 226 as the mandrel 204 moves within the sleeve 202. The leading edge 224 can be positioned radially closer to a central longitudinal axis of the mandrel 204. Moving the mandrel 204 through the sleeve 202 can cause the leading edge 224 of the cam surface 222 to contact the cutting element 206*b* before the trailing edge 226. Continued movement of the mandrel 204 through the sleeve 202 can cause the cam-following surface 228 of the cutting element 206*b* to be pushed up along the cam surface 222 toward the trailing edge 226.

In some aspects, the cam-following surface 228 of the cutting element 206 can be a sloped surface. In one example, the cam-following surface 228 of the cutting element 206 can include a distal edge 230 and a proximal edge 232. The proximal edge 232 can be radially positioned further from a central longitudinal axis of the sleeve 202 than the distal edge 230. The sloped surface of the cam-following surface 228 can match or otherwise correspond to a geometry of an incline of the cam surface 222. Matching geometry can increase a contact surface area between the cam surface 222 and the cam-following surface 228. Increased contact surface area can reduce stress in the cutting element 206*b* or the protrusion 214*b* (or both) that can occur as the protrusion 214*b* exerts a force on the cutting element 206*b*.

Figure 4:
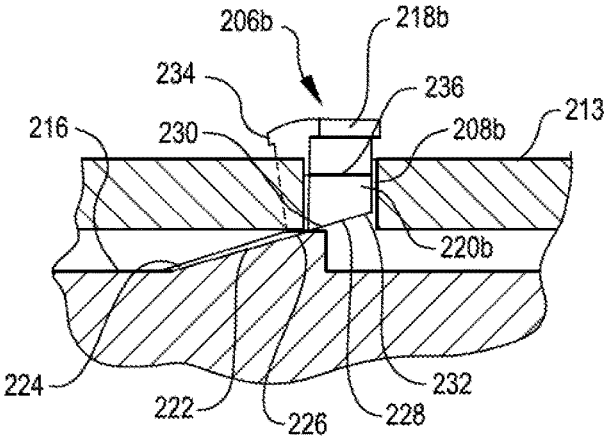
FIG. 4 is a cross sectional view of a cutting element radially extended by contact with a protrusion on a mandrel according to one aspect of the present disclosure.

FIG. 4 is a cross sectional view of the cutting element 206*b* radially extended by contact with the protrusion 214*b* on the mandrel 204. Moving the mandrel 204 through the sleeve 202 can move the cam surface 222 relative to the cutting element 206*b*. Movement of the cam surface 222 can cause the cam-following surface 228 on the cutting element 206 to shift. For example, as the trailing edge 226 of the cam surface 222 comes into contact with the distal edge 230 of the cutting element 206, the cutting element 206 can be pushed up the ramp of the cam surface 222. Movement of the cam surface 222 can cause the cutting element 206 to radially extend, at least partially, out of the sleeve 202. The radial extension of the cutting element 206 can cut a hole in a tubing element surrounding the cutting tool 200, such as the tubing 112 depicted in FIG. 1.

In some aspects, the cutting element 206 can include a tooth 218 and a base 220. The tooth 218 can be connected to the base 220 to form the cutting element 206. In some aspects, a junction 236 between the tooth 218 and the base 220 of the cutting element 206 can be aligned near or with the outer surface 213 of the sleeve 202 when the cutting element 206 is in an extended state. For example, the junction 236 can be slightly radially outward or slightly radially inward or radially even with the outer surface 213 of the sleeve 202. Such an alignment can facilitate separation of the tooth 218 from the base 220 in some aspects. In one example, the tooth 218 may become lodged in a tubular element as the cutting element 206 extends into the tubular element in a cutting operation. The lodged tooth 218 can separate or detach from the base 220 such that the cutting tool 200 can be readily extracted from the cut tubular element.

In some aspects, the cutting element 206 can include a lip 234. The lip 234 can extend from the cutting element 206 along a circumference of the sleeve 202. The lip 234 can reduce gaps in a cut in a tubular element. For example, groove segments 208*a-i* may be separated by internal structure joining the two sides of the sleeve 202 on either side of the groove 208. The lip 234 may provide an extension of the tooth 218 that covers the internal structure so that cuts provided by adjacent cutting elements 206*a-i* are not separated by gaps corresponding to the internal structure between the adjacent cutting elements 206*a-i*.

Figure 5:
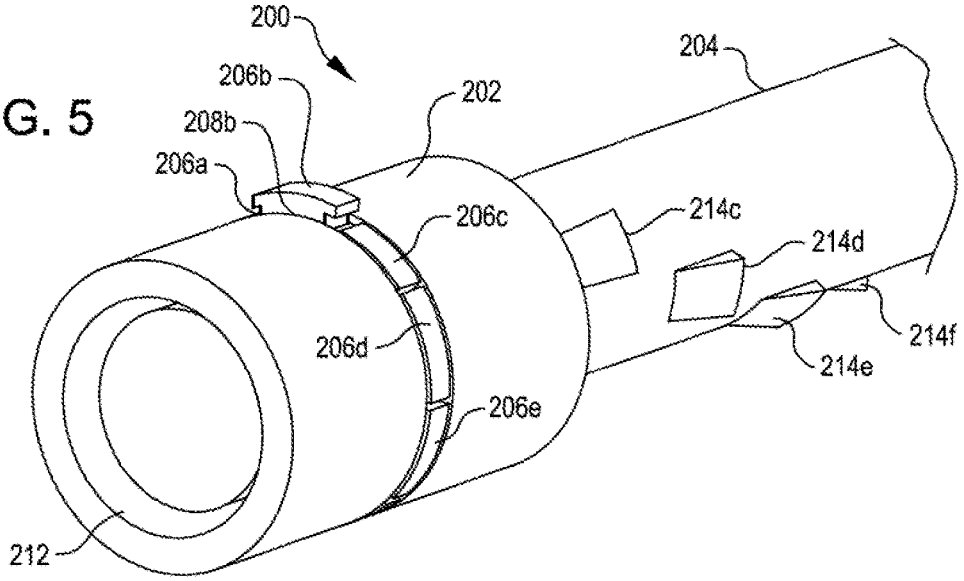
FIG. 5 is a perspective view of a cutting tool having a cutting element radially extending from the cutting sleeve according to one aspect of the present disclosure.

FIG. 5 is a perspective view of the cutting tool 200 having a cutting element 206*b* radially extending from the sleeve 202. Longitudinal movement of the mandrel 204 through the bore 212 can cause the protrusion 214*b* to contact and extend the cutting element 206*b*, as described above with respect to FIGS. 3-4. The protrusion 214*b* is not visible in FIG. 5 because the protrusion 214*b* is within the bore 212 of the sleeve 202.

Figure 6:
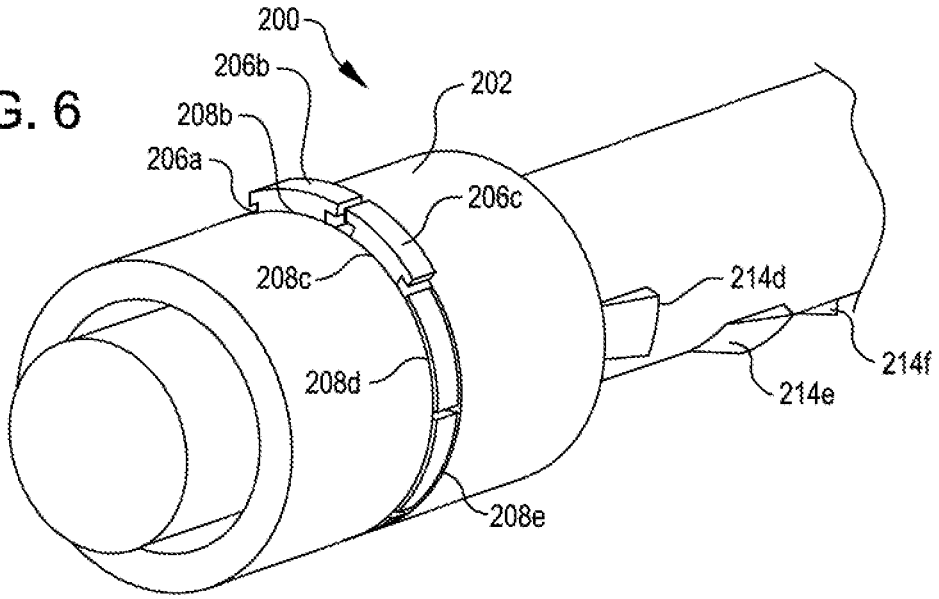
FIG. 6 is a perspective view of a cutting tool with two cutting elements radially extended according to one aspect of the present disclosure.

FIG. 6 is a perspective view of the cutting tool 200 with two cutting elements 206*b*, 206*c* radially extended. Continued linear movement of the mandrel 204 through the sleeve 202 from the position depicted in FIG. 5 can move the protrusion 214*c* into the bore 212. The protrusion 214*c* can be moved into contact with the cutting element 206*c*. Contact between the protrusion 214*c* and the cutting element 206*c* can cause the cutting element 206*c* to extend radially from the groove segment 208*c* in the sleeve 202. The contact can cause radial extension of the cutting element 206*c* in a manner similar to the interaction of the protrusion 214*b* and the cutting element 206*b* described with respect to FIGS. 3-4 above. Arranging the protrusions 214*a-i* in a spiral along the longitudinal length of the mandrel 204 can cause adjacent cutting elements (such as 206*b*, 206*c*) to sequentially extend radially in response to a consistent linear movement of the mandrel 204.

Figure 7:
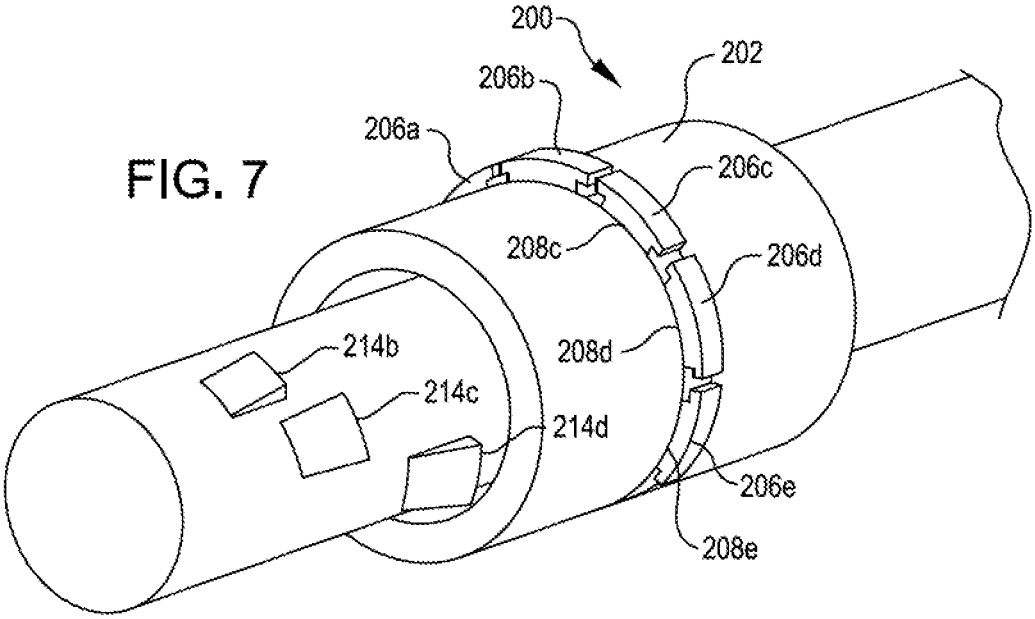
FIG. 7 is a perspective view of a cutting tool with multiple cutting elements radially extended according to one aspect of the present disclosure.

FIG. 7 is a perspective view of the cutting tool 200 with multiple cutting elements 206*a-i* radially extended. The mandrel 204 can extend through the bore 212 of sleeve 202. For example, the mandrel 204 can extend through the sleeve 202 such that multiple protrusions 214*b-d* are positioned outside of the bore 212 of the sleeve 202. Continued linear longitudinal movement of the mandrel 204 through the sleeve 202 can result in all cutting elements 206*a-i* being radially extended relative to the sleeve 202. For example, movement of the mandrel 204 through the sleeve 202 from the position depicted in FIG. 6 can move the protrusions 214*c-i* through the bore 212. The protrusions 214*c-i* can respectively be moved into contact with the cutting elements 206*c-i*. Contact between the protrusions 214*c-i* and the cutting element 206*c-i* can cause the cutting element 206*c-i* to extend radially from the groove segments 208*c-i* in the sleeve 202. The respective contact can cause radial extension of the cutting elements 206*c-i* in a manner similar to the interaction of the protrusion 214*b* and the cutting element 206*b* described with respect to FIGS. 3-4 above.

In some aspects, one or more cutting elements 206 can have a sharp cutting edge. In such aspects, the cutting element 206 can end in a thin portion providing a blade-like edge. In some aspects, one or more cutting elements 206 can have a blunt cutting edge. In such aspects, the cutting element 206 can end in a thick portion for displacing mass. A cutting element 206 with a sharp cutting edge may be less suitable for cutting tubular elements in compression than a cutting element 206 with a blunt cutting edge. For example, if a cutting element 206 is used to pierce a tubular element in compression, the tubular element may pinch against and exert compression forces upon the cutting edge of the cutting element 206. If the cutting edge is sharp and thin, the cutting element 206 may have insufficient strength to withstand compression forces without snapping, bending, or otherwise becoming damaged before a perforation through the tubular element can be completed. In such cases, cutting effectiveness of the cutting element 206 may be reduced. In contrast, if the cutting edge is blunt and thick, the cutting elements 206 may have sufficient strength to withstand the compression forces in the tubular element. Accordingly, use of cutting elements 206 with blunt cutting edges can improve cutting performance in a tubular element that is in compression.

Arranging the protrusions 214 in a spiral along the longitudinal length of the mandrel 204 can allow individual cutting elements 206 to radially extend one at a time. Radially extending the cutting elements 206 one at a time can divide a circumferential cut through a tubular element into a series of smaller, temporally-staggered cuts. Temporally staggering cuts can allow a lower magnitude force to be used to cut an entire circumference of the tubular element in the following manner. A force sufficient to displace a small amount of mass of a tube in making a small cut can be smaller than a force sufficient to displace a larger amount of mass in a larger cut. Accordingly, a force exerted on the mandrel 204 for pushing a cutting element 206 to cut a partial circumference of a tube can be of a smaller magnitude than a force exerted on the mandrel 204 to cut the entire circumference by simultaneously pushing all cutting elements 206. In this way, arranging cutting elements 206 along a length of the mandrel 204 can allow a lower force to be used to cut the tubular element. The protrusions 214 can thus be arranged to reduce an amount of force needed to create a perforation.

Although the cutting tool 200 is depicted in FIGS. 2-7 with nine cutting elements 206*a-i* and nine protrusions 214*a-i*, other arrangements are possible. In some aspects, the cutting tool 200 can include fewer or more than nine cutting elements 206. In some aspects, the protrusions 214 are arranged in a configuration that is not a spiral. The protrusions 214 can be arranged in other arrangements that provide staggered cutting action of cutting elements 206 through radial extension of the cutting elements 206. In some aspects, other arrangements of protrusions 214 can provide non-simultaneous radial extension of cutting elements 206 from the sleeve 202 for cutting a tubular element. One such configuration is depicted in FIGS. 8 and 9 below.

Figure 8:
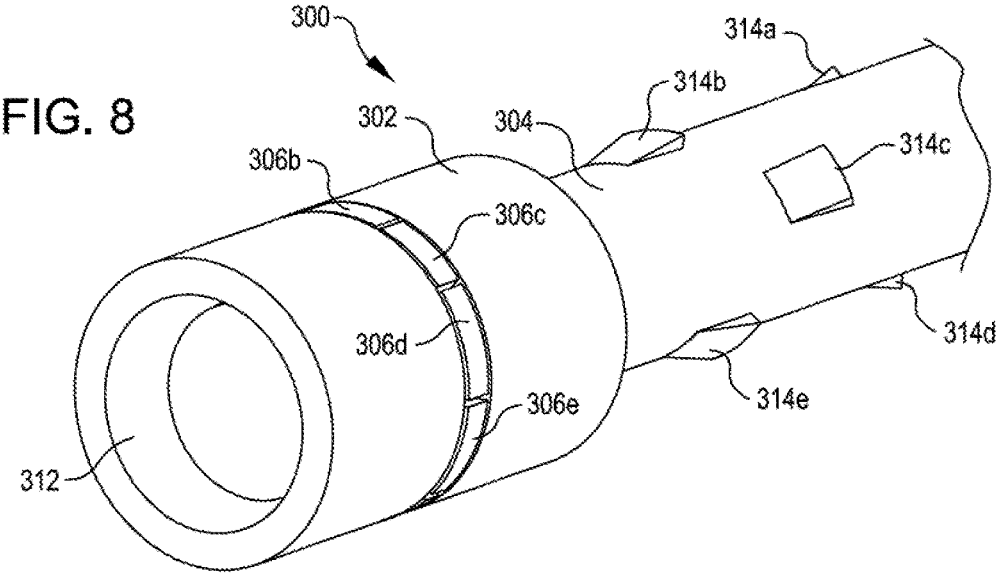
FIG. 8 is a perspective view of another example of a cutting tool according to one aspect of the present disclosure.

FIG. 8 is a perspective view of another example of a cutting tool 300. The cutting tool 300 can include a sleeve 302 and a mandrel 304. The sleeve 302 can include a plurality of cutting elements 306*a-f*. The mandrel 304 can include a plurality of protrusions 314*a-f* corresponding to the cutting elements 306*a-f*. The mandrel 304 can be sized for passing through a bore 312 of the sleeve 302. The mandrel 304 can include protrusions 314 arranged in opposing pairs along a longitudinal length of the mandrel 304. In some aspects, the protrusions 314*b* and 314*e* can be arranged around a common circumference or perimeter of the mandrel 304. In one example, the protrusions 314*b* and 314*e* are positioned at opposite ends of a diameter of the mandrel 304.

Figure 9:
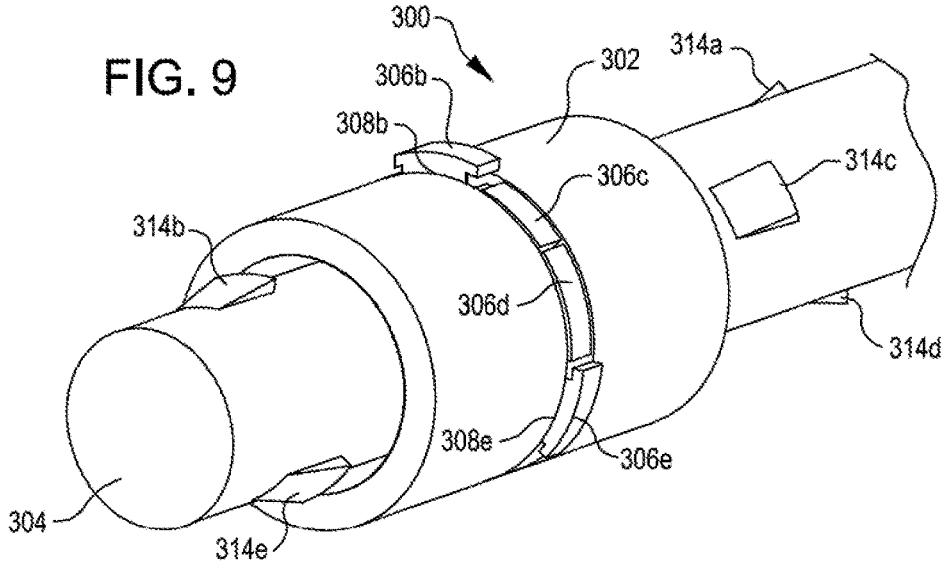
FIG. 9 is a perspective view of the cutting tool of FIG. 8 with a pair of cutting elements radially extended according to one aspect of the present disclosure.

FIG. 9 is a perspective view of the cutting tool 300 of FIG. 8 with a pair of cutting elements 306*b*, 306*e* radially extended. Movement of the mandrel 304 through the sleeve 302 can cause protrusions 314 to engage or interact with cutting elements 306 to cause the cutting elements to radially extend. For example, the protrusions 314*b* and 314*e* can simultaneously engage cutting elements 306*b* and 306*e* while the mandrel 304 passes through the sleeve 302. In this way, multiple cutting elements 206 may be radially extended from the sleeve 202 while still requiring less force than simultaneously radially extending all cutting elements 306 from the sleeve 202.

Figure 10:
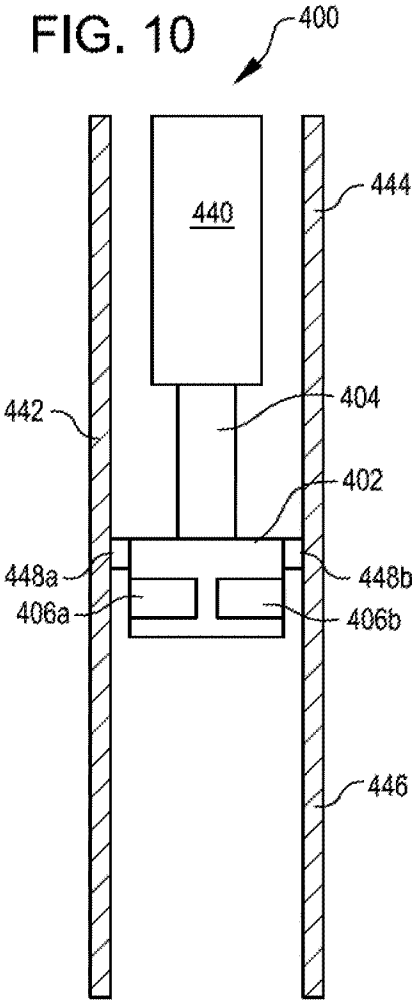
FIG. 10 is a cross sectional view of a cutting tool anchored in a tubular element according to one aspect of the present disclosure.

FIG. 10 is a cross sectional view of a cutting tool 400 anchored in a tubular element 442. The cutting tool 400 may be deployed to separate the tubular element 442 into a first portion 444 and a second portion 446. The cutting tool 400 can include an activator 440, a mandrel 404, a sleeve 402, cutting elements 406, and anchors 448. The cutting tool 400 can be positioned in the tubular element 442. In one example, the tubular element 442 is part of the tubing string 112 depicted in FIG. 1.

The anchor 448 can secure the cutting tool 400 relative to the tubular element 442. In one example, the anchor 448 secures the sleeve 402 to the tubular element 442. Anchoring the sleeve 402 to the tubular element 442 can stabilize the sleeve 402 during cutting operations. For example, anchoring may stabilize the sleeve 402 for providing a consistent cut along a continuous circumference of the tubular element 442. A non-limiting example of the anchor 448 is a packing element.

The activator 440 can provide a linear force for pushing the mandrel 404 through the sleeve 402. Non-limiting examples of an activator 440 include a battery-powered electronic actuator, an electronic actuator powered via an electrical cable running to a power source located at a surface of the well, an actuator using power provided by a pressure of fluids in the well, an actuator powered by a hydraulic or other control line running to the surface, or any other tool capable of providing a linear force in a wellbore.

Figure 11:
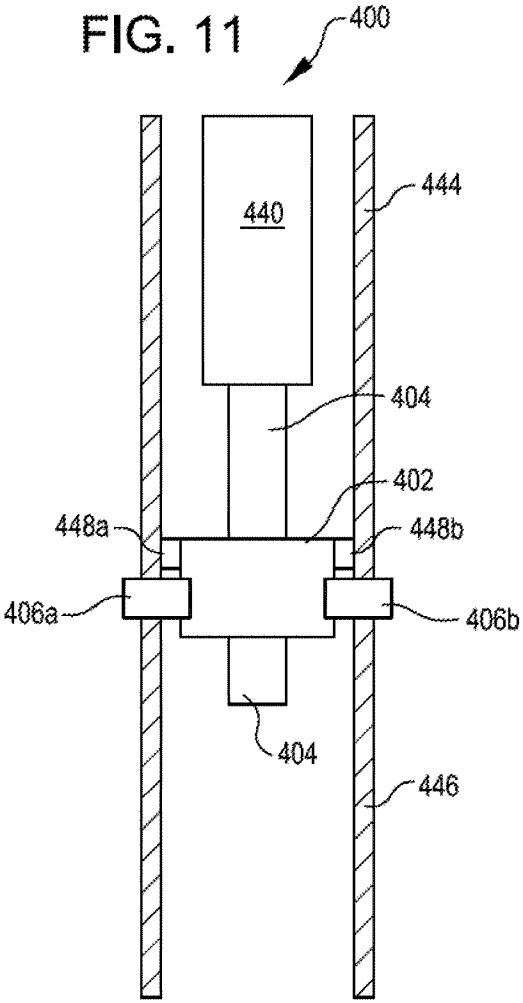
FIG. 11 is a cross sectional view of the cutting tool of FIG. 10 with cutting elements radially extended according to one aspect of the present disclosure.

FIG. 11 is a cross sectional view of the cutting tool 400 of FIG. 10 with cutting elements 406*a-b* radially extended. The activator 440 can exert a force on the mandrel 204 to cause the mandrel 204 to move through the sleeve 402. Movement of the mandrel 404 through the sleeve 402 can cause the cutting elements 406*a* and 406*b* to radially extend from the sleeve 402. The cutting elements 406 can radially extend into the tubular element 442. The cutting elements 406 can extend through the tubular element 442 to produce a series of holes or perforations in the tubular element 442. In some aspects, the cutting elements 406 can produce perforations that abut one another to provide a continuous cut around a perimeter of the tubular element 442. In other aspects, the cutting elements 206 produce a series of adjacent, but not abutting, holes in the tubular element 442. Producing a series of unconnected holes in the tubular element 442 can produce a weakened section in the tubular element 442.

Figure 12:
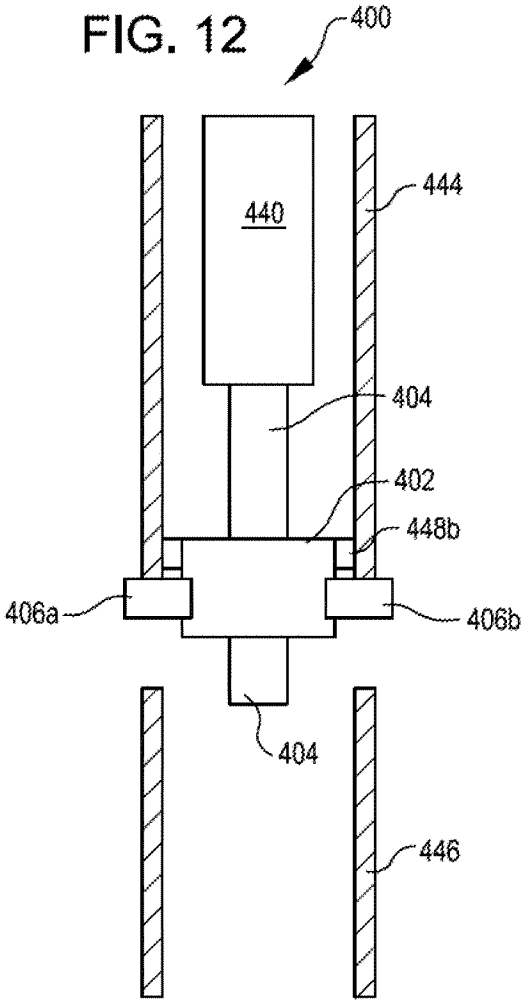
FIG. 12 is a cross sectional view of the cutting tool of FIGS. 10-11 relative to two severed portions of the tubular element according to one aspect of the present disclosure.

FIG. 12 is a cross sectional view of the cutting tool 400 of FIGS. 10-11 relative to two severed portions 444, 446 of the tubular element 442. In aspects where the cutting elements 406 provide a continuous cut around the tubular element 442, the cut can sever a first portion 444 of the tubular element 442 from a second portion 446 of the tubular element 442. In aspects where the cutting elements 406 provide a weakened section of the tubular element 442, the holes can be utilized to sever the first portion 444 of the tubular element 442 from the second portion 446 of the tubular element 442. In one example, the weight of the second portion 446 of the tubular element 442 can cause the tubular element 442 to rupture at the weakened portion of the tubular element 442. This can sever the tubular element 442 and provide separation between the first portion 444 and the second portion 446. In another example, a force can be exerted on the first portion 444 of the tubular element 442 in a direction away from the weakened section of the tubular element 442. For example, a hoisting mechanism coupled with the tubular element 442 at a surface of the well system can be used to exert a force on the first portion 444 of the tubular element 442. The second portion 446 of the tubular element 442 may be secured in the wellbore. Exerting the force on the first portion 444 of the tubular element 442 via the hoisting mechanism may cause the tubular element 442 to sever at the weakened portion where the cutting elements 406 produced perforations in the tubular element 442.

Figure 13:
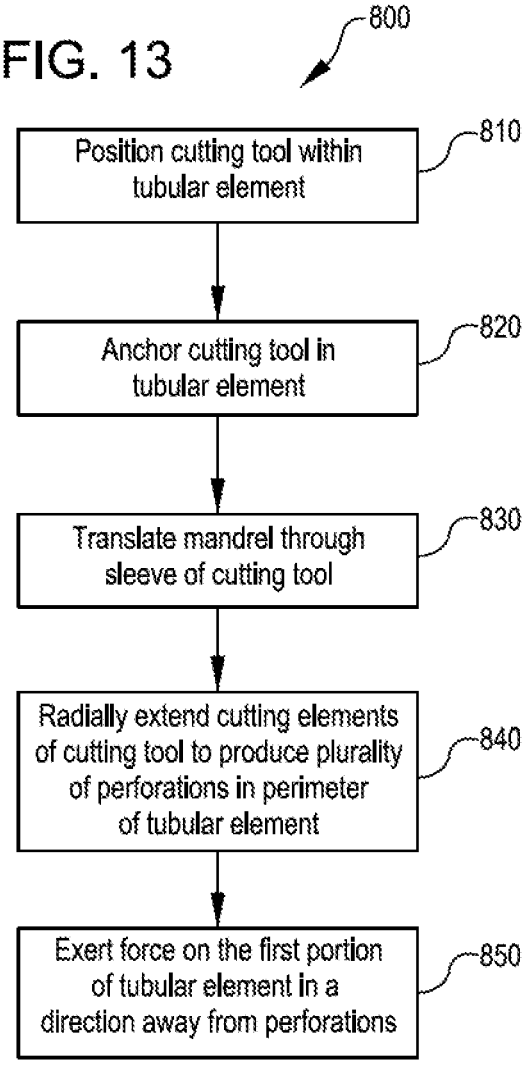
FIG. 13 is a flowchart illustrating an example method for severing a portion of a tubular element from another portion of the tubular element according to one aspect of the present disclosure.

FIG. 13 is a flowchart illustrating an example method 800 for severing a portion of a tubular element from another portion of the tubular element. The method 800 can include positioning a cutting tool within a tubular element, as at block 810. In one example, the cutting tool can be a cutting tool 400 as depicted in FIGS. 10-12. The cutting tool may be positioned in the tubular element 442 as described above with respect to FIG. 10.

The method 800 can include anchoring the cutting tool in the tubular element, as at block 820. For example, the cutting tool can be anchored with anchors such as anchors 448 described above with respect to FIGS. 10-12. In some aspects, the block 820 can be omitted from the method 800.

The method 800 can include moving a mandrel through a sleeve of the cutting tool, as at block 830. For example, an activator 440 (e.g., an electrically or hydraulically powered actuator) can exert a force on the mandrel 404 to cause the mandrel 404 to be moved through the sleeve 402 of the cutting tool 400 as described above with respect to FIG. 10.

The method 800 can include radially extending cutting elements of the cutting tool to produce a plurality of perforations and a parameter of a tubular element positioned around the cutting tool, as at block 840. For example, cutting elements 206 may radially extend in response to engagement with protrusions 214 on a mandrel 204, as described above with respect to FIGS. 3 and 4.

The method 800 can include exerting a force on a first portion of the tubular element in a direction away from the perforations produced by the cutting elements, as at block 850. For example, a hoisting mechanism can be used to exert a force on the first portion 444 of the tubular element 442, as described above with respect to FIG. 12. In some aspects, the block 850 can be omitted from the method 800.

In some aspects, a cutting tool is provided for cutting a tubular element in a wellbore. The cutting tool may include a mandrel, a sleeve, a first cutting element, and a second cutting element. The mandrel can have a first protrusion positioned at a first length along the mandrel and a second protrusion positioned at a second length along the mandrel. The sleeve can at least partially surround the mandrel. The first cutting element can be movable from a first position within the sleeve to a second position at least partially protruding from the sleeve in response to a first force exerted on the first cutting element by the first protrusion. The second cutting element can be movable from a third position within the sleeve to a fourth position at least partially protruding from the sleeve in response to a second force exerted on the second cutting element by the second protrusion.

The cutting tool may feature a first protrusion that includes an angled surface aligned for contact with the first cutting element. The first cutting element can be movable toward the second position in response to contact between the first cutting element and the angled surface pushing the first cutting element up the angled surface.

The cutting tool may feature a first protrusion and a second protrusion that are included in a plurality of protrusions arranged in a spiral about a longitudinal length of the mandrel. The cutting tool may feature a first protrusion and a second protrusion that are included in a plurality of protrusions arranged in opposing pairs about a longitudinal length of the mandrel.

The cutting tool may feature a first cutting element that includes a tooth detachable when the first cutting element is in the second position. The cutting tool may feature a first cutting element that includes a blunt cutting edge. The cutting tool may feature a first cutting element that is radially movable to the second position in response to a longitudinal force exerted on the mandrel.

A downhole assembly can be provided. The downhole assembly can include a sleeve, multiple cutting elements, and a mandrel. The cutting elements can be arranged about a circumference of the sleeve. The cutting elements can be radially extendable from the sleeve. The mandrel can be longitudinally positionable relative to and within the sleeve. The mandrel can include multiple protrusions arranged along an outer diameter of the mandrel. The protrusions can interact with the plurality of cutting elements to extend the plurality of cutting elements from the sleeve in response to a longitudinal movement of the mandrel.

The downhole assembly may feature at least one ramp situated on at least one of a protrusion or a cutting element. The cutting element can extend from the sleeve in response to the protrusion pushing the cutting element radially via the ramp by longitudinal movement of the mandrel.

The downhole assembly may feature the protrusions arranged in a spiral about a longitudinal length of the mandrel. The downhole assembly may feature at least two of the protrusions situated at opposite ends of a diameter of the mandrel.

The downhole assembly may feature cutting elements that are radially extendable from the sleeve for producing a plurality of perforations in a tubular element positioned about the sleeve. The downhole assembly may feature cutting elements that span the circumference of the sleeve.

The downhole assembly may feature an activator that can longitudinally position the mandrel. The activator can be an electrically powered actuator. The activator can be a hydraulically powered actuator.

The downhole assembly may feature an anchoring mechanism that can secure the sleeve in place relative to a tubular element during cutting of the tubular element via the plurality of cutting elements.

In some aspects, a method can be provided for severing a portion of a tubular element from another portion of the tubular element. The method can include positioning a cutting tool within a tubular element. The cutting tool can include a sleeve, multiple cutting elements arranged radially about the sleeve, and a mandrel including multiple protrusions arranged along a longitudinal length of the mandrel. The method can include moving the mandrel through the sleeve such that the protrusions engage with the cutting elements. The method can include, radially extending the cutting elements into the tubular element in response to the engaging of the protrusions with the cutting elements. Radially extending the cutting elements into the tubular element can produce multiple perforations in the tubular element for severing a first portion of the tubular element on one side of the perforations from a second portion of the tubular element on an opposite side of the perforations.

The method can also include anchoring the sleeve in the tubular element. The method can also include exerting a force on the first portion of the tubular element in a direction away from the perforations for severing the tubular element along the perforations. Moving the mandrel through the sleeve can include moving the mandrel by exerting a force on the mandrel from an actuator.

The foregoing description of the aspects, including illustrated examples, of the disclosure has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A cutting tool, comprising:

a mandrel having a first protrusion positioned at a first longitudinal position along the mandrel and a second protrusion positioned at a second longitudinal position along the mandrel;

a sleeve at least partially surrounding the mandrel;

a first cutting element at a longitudinal position along the sleeve movable from a first position within the sleeve to a second position at least partially protruding from the sleeve in response to a first force exerted on the first cutting element by the first protrusion; and a second cutting element at the longitudinal position along the sleeve movable from a third position within the sleeve to a fourth position at least partially protruding from the sleeve in response to a second force exerted on the second cutting element by the second protrusion, the first cutting element being independently movable with respect to the second cutting element.

2. The cutting tool of claim 1, wherein the first protrusion includes an angled surface aligned for contact with the first cutting element, wherein the first cutting element is movable toward the second position in response to contact between the first cutting element and the angled surface pushing the first cutting element up the angled surface.

3. The cutting tool of claim 1, wherein the first protrusion and the second protrusion are included in a plurality of protrusions arranged in a spiral about a longitudinal length of the mandrel.

4. The cutting tool of claim 1, wherein the first protrusion and the second protrusion are included in a plurality of protrusions arranged in opposing pairs about a longitudinal length of the mandrel.

5. The cutting tool of claim 1, wherein the first cutting element includes a tooth detachable when the first cutting element is in the second position.

6. The cutting tool of claim 1, wherein the first cutting element includes a blunt cutting edge.

7. The cutting tool of claim 1, wherein the first cutting element is radially movable to the second position in response to a longitudinal force exerted on the mandrel.

8. A downhole assembly, comprising:

a sleeve;

a plurality of cutting elements arranged about a circumference of the sleeve and radially extendable from the sleeve, wherein a first cutting element of the plurality of cutting elements is at a longitudinal position along the sleeve and a second cutting element of the plurality of cutting elements is at the longitudinal position along the sleeve; and a mandrel longitudinally positionable relative to and within the sleeve, the mandrel including a plurality of protrusions arranged along an outer diameter of the mandrel, wherein a first protrusion of the plurality of protrusions is positioned at a first longitudinal position along the outer diameter of the mandrel and a second protrusion of the plurality of protrusions is positioned at a second longitudinal position along the outer diameter of the mandrel that is different from the first longitudinal position, and wherein the plurality of protrusions operable for interacting with the plurality of cutting elements to extend the plurality of cutting elements from the sleeve in response to a longitudinal movement of the mandrel, wherein the first cutting element of the plurality of cutting elements is independently movable with respect to the second cutting element of the plurality of cutting elements.

9. The downhole assembly of claim 8, further comprising at least one ramp situated on at least one of a protrusion or a cutting element, wherein the cutting element is extendable from the sleeve in response to the protrusion pushing the cutting element radially via the ramp by longitudinal movement of the mandrel.

10. The downhole assembly of claim 8, wherein the plurality of protrusions is arranged in a spiral about a longitudinal length of the mandrel.

11. The downhole assembly of claim 8, wherein at least two of the protrusions of the plurality of protrusions are situated at opposite ends of a diameter of the mandrel.

12. The downhole assembly of claim 8, wherein the cutting elements of the plurality of cutting elements are radially extendable from the sleeve for producing a plurality of perforations in a tubular element positioned about the sleeve.

13. The downhole assembly of claim 8, wherein the cutting elements span the circumference of the sleeve.

14. The downhole assembly of claim 8, further comprising an activator operable for longitudinally positioning the mandrel.

15. The downhole assembly of claim 14, wherein the activator comprises at least one of an electrically powered actuator or a hydraulically powered actuator.

16. The downhole assembly of claim 8, further comprising an anchoring mechanism operable for securing the sleeve in place relative to a tubular element during cutting of the tubular element via the plurality of cutting elements.

17. A method comprising:

positioning a cutting tool within a tubular element, the cutting tool comprising a sleeve, a plurality of cutting elements arranged radially about the sleeve, wherein a first cutting element of the plurality of cutting elements is at a longitudinal position along the sleeve and a second cutting element of the plurality of cutting elements is also at the longitudinal position along the sleeve, and a mandrel including a plurality of protrusions arranged along a longitudinal length of the mandrel, wherein a first protrusion of the plurality of protrusions is at a first longitudinal position along the mandrel and a second protrusion of the plurality of protrusions is at a second longitudinal position, different from the first longitudinal position;

moving the mandrel through the sleeve such that the protrusions of the plurality of protrusions engage with the cutting elements of the plurality of cutting elements; and in response to the engaging of the protrusions with the cutting elements, radially extending the cutting elements into the tubular element to produce a plurality of perforations in the tubular element for severing a first portion of the tubular element on one side of the perforations from a second portion of the tubular element on an opposite side of the perforations, wherein the first cutting element of the plurality of cutting elements is independently movable with respect to the second cutting element of the plurality of cutting elements.

18. The method of claim 17, further comprising:

anchoring the sleeve in the tubular element.

19. The method of claim 17, further comprising:

exerting a force on the first portion of the tubular element in a direction away from the perforations for severing the tubular element along the perforations.

20. The method of claim 17, wherein moving the mandrel through the sleeve include moving the mandrel by exerting a force on the mandrel from an actuator.

* * * * *